US007013541B2

(12) United States Patent
Rivera et al.

(10) Patent No.: US 7,013,541 B2
(45) Date of Patent: Mar. 21, 2006

(54) NONWOVEN FABRICS HAVING COMPOUND THREE-DIMENSIONAL IMAGES

(75) Inventors: Miguel Rivera, Mooresville, NC (US); Ralph A. Moody, III, Mooresvile, NC (US); Benjamin Nolan, Elmer, NJ (US); Michael Putnam, Fuquay-Varina, NC (US)

(73) Assignee: Polymer Group, Inc., North Charleston, SC (US)

( * ) Notice: Subject to any disclaimer, the term of this patent is extended or adjusted under 35 U.S.C. 154(b) by 207 days.

(21) Appl. No.: 10/408,487

(22) Filed: Apr. 7, 2003

(65) Prior Publication Data

US 2004/0000042 A1 Jan. 1, 2004

Related U.S. Application Data

(60) Provisional application No. 60/370,648, filed on Apr. 8, 2002.

(51) Int. Cl.
*D04H 1/46* (2006.01)

(52) U.S. Cl. ..... 28/104; 28/167; 28/163

(58) Field of Classification Search ..... 28/104, 28/105, 106, 103, 163, 167; 442/384, 387, 442/408; 264/294, 500, 509, 555, 557, 280
See application file for complete search history.

(56) References Cited

U.S. PATENT DOCUMENTS

| | | | | | |
|---|---|---|---|---|---|
| 3,276,944 | A | | 10/1966 | Levy | |
| 3,338,992 | A | | 8/1967 | Kinney | |
| 3,341,394 | A | | 9/1967 | Kinney | |
| 3,485,706 | A | * | 12/1969 | Franklin | 428/134 |
| 3,502,538 | A | | 3/1970 | Petersen | |
| 3,502,763 | A | | 3/1970 | Hartmann | |
| 3,508,308 | A | * | 4/1970 | Bunting, Jr. et al. | 28/104 |
| 3,509,009 | A | | 4/1970 | Hartmann | |
| 3,542,615 | A | | 11/1970 | Dobo et al. | |
| 4,091,140 | A | | 5/1978 | Harmon | |
| 4,190,695 | A | | 2/1980 | Niederhauser | |
| 4,636,419 | A | | 1/1987 | Madsen et al. | |
| 5,098,764 | A | | 3/1992 | Bassett et al. | |
| 5,144,729 | A | | 9/1992 | Austin et al. | |
| 5,187,005 | A | | 2/1993 | Stahle et al. | |
| 5,369,858 | A | * | 12/1994 | Gilmore et al. | 28/104 |
| 5,413,849 | A | * | 5/1995 | Austin et al. | 442/329 |
| 5,475,903 | A | | 12/1995 | Collins | |
| 5,678,379 | A | | 10/1997 | Quattrociocchi | |
| 6,063,717 | A | * | 5/2000 | Ishiyama et al. | 442/387 |
| 6,114,017 | A | | 9/2000 | Fabbricante et al. | |
| 6,314,627 | B1 | * | 11/2001 | Ngai | 28/104 |
| 6,502,288 | B1 | | 1/2003 | Black et al. | |
| 2001/0005926 | A1 | * | 7/2001 | Noelle | 28/104 |
| 2002/0146957 | A1 | | 10/2002 | Fuller et al. | |

* cited by examiner

*Primary Examiner*—Amy B. Vanatta
(74) *Attorney, Agent, or Firm*—Wood, Phillips, Katz, Clark & Mortimer

(57) ABSTRACT

The present invention is directed to a method of forming a nonwoven fabric, which exhibits a first three-dimensional image and a second three-dimensional image whereby the first and second three-dimensional images are dissimilar from one another. In particular, the present invention contemplates a fabric comprised of sequentially formed three-dimensional images that are formed from a pre-entangled precursor web entangled on a first three-dimensional transfer device so as to impart a first image therein, then subjected to hydroentanglement on a second three-dimensional image transfer device wherein a second three-dimensional image is imparted to the web that is different from the first three-dimensional image, the resulting nonwoven fabric presenting aesthetic and tactile qualities representative of both imparted images.

7 Claims, 3 Drawing Sheets

Prior Art

NONWOVEN FABRICS HAVING COMPOUND THREE-DIMENSIONAL IMAGES

This application claims benefit of U.S. provisional No. 60/370,648 filed Apr. 8, 2002.

TECHNICAL FIELD

The present invention relates generally to methods of making nonwoven fabrics, and more particularly, to a method of manufacturing a nonwoven fabric exhibiting improved physical characteristics while exhibiting a first three-dimensional image and a second three-dimensional image whereby the first and second three-dimensional images are dissimilar, permitting use of the fabric in a wide variety of consumer applications.

BACKGROUND OF THE INVENTION

The production of conventional textile fabrics is known to be a complex, multi-step process. The production of fabrics from staple fibers begins with the carding process whereby the fibers are opened and aligned into a feedstock referred to in the art as "sliver". Several strands of sliver are then drawn multiple times on a drawing frames to further align the fibers, blend, improve uniformity and reduce the sliver's diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high-speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes, as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared to conventional textiles, particularly in terms of resistance to elongation, in applications where both transverse and co-linear stresses are encountered. Hydroentangled fabrics have been developed with improved properties, by the formation of complex composite structures in order to provide a necessary level of fabric integrity. Subsequent to entanglement, fabric durability has been further enhanced by the application of binder compositions and/or by thermal stabilization of the entangled fibrous matrix.

Nonwoven composite structures typically improve physical properties, such as elongation, by way of incorporation of a support layer or scrim. The support layer material can comprise an array of polymers, such as polyolefins, polyesters, polyurethanes, polyamides, and combinations thereof, and take the form of a film, fibrous sheeting, or grid-like meshes. Metal screens, fiberglass, and vegetable fibers are also utilized as support layers. The support layer is commonly incorporated either by mechanical or chemical means to provide reinforcement to the composite fabric. Reinforcement layers, also referred to as a "scrim" material, are described in detail in U.S. Pat. No. 4,636,419, which is hereby incorporated by reference. The use of scrim material, more particularly, a spunbond scrim material is known to those skilled in the art.

Spunbond material comprises continuous filaments typically formed by extrusion of thermoplastic resins through a spinneret assembly, creating a plurality of continuous thermoplastic filaments. The filaments are then quenched and drawn, and collected to form a nonwoven web. Spunbond materials have relatively high resistance to elongation and perform well as a reinforcing layer or scrim. U.S. Pat. No. 3,485,706 to Evans, et al., which is hereby incorporated by reference, discloses a continuous filament web with an initial random staple fiber batt mechanically attached via hydroentanglement, then a second random staple fiber batt is attached to the continuous filament web, again, by hydroentanglement. A continuous filament web is also utilized in U.S. Pat. No. 5,144,729, U.S. Pat. No. 5,187,005, and U.S. Pat. No. 4,190,695. These patents include a continuous filament web for reinforcement purposes or to reduce elongation properties of the composite.

More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, which is hereby incorporated by reference; with the use of such image transfer devices being desirable for providing a fabric with enhanced physical properties as well as an aesthetically pleasing appearance.

For specific applications, a compound three-dimensionally imaged nonwoven fabric must exhibit a combination of specific physical characteristics. For example, when such fabrics are used in the formation of cleansing or dusting wipes, the fabric must exhibit sufficient durability to withstand application upon abrasive surfaces and yet exhibit a pronounced three-dimensional pattern so as to capture and retain particulates. Further, compound three-dimensionally imaged nonwoven fabrics used in home, medical and hygiene applications require sufficient resistance to elongation so as to resist deformation of the image when the fabric is converted into a final end-use article and when used in the final application.

Notwithstanding various attempts in the prior art to develop a compound three-dimensionally imaged nonwoven fabric acceptable for home, medical and hygiene applications, a need continues to exist for a nonwoven fabric which provides a pronounced image, as well as the requisite mechanical characteristics.

SUMMARY OF THE INVENTION

The present invention is directed to a method of forming a nonwoven fabric, which exhibits a first three-dimensional image and a second three-dimensional image whereby the first and second three-dimensional images are dissimilar from one another. In particular, the present invention contemplates a fabric comprised of sequentially formed three-dimensional images that are formed from a pre-entangled precursor web entangled on a first three-dimensional transfer device so as to impart a first image therein, then subjected to hydroentanglement on a second three-dimensional image transfer device wherein a second three-dimensional image is imparted to the web that is different from the first three-dimensional image, the resulting nonwoven fabric presenting aesthetic and tactile qualities representative of both imparted images.

In accordance with the present invention, a method of making a nonwoven fabric includes the steps of providing a precursor web comprising a fibrous matrix. While use of staple length fibers is typical, the fibrous matrix may comprise substantially continuous filaments. In a particularly preferred form, the fibrous matrix comprises staple length fibers, which are carded and cross-lapped to form a precursor web. In one embodiment, one or more layers of fibrous matrix are juxtaposed with one or more support layers or scrims. The layered construct is pre-entangled on a foraminous surface to form a precursor web. The precursor web is then hydroentangled on a three-dimensional image transfer device to impart a first three-dimensional image to the web. The web is then either directly imparted with a second imaged, or subjected to further fiber, filament, support layers, or scrim layers prior to hydroentanglement on a second image transfer device imparting a second three-dimensional image.

The present method further contemplates the provision of at least first and second three-dimensional image transfer devices, each having an independent and movable imaging surface. In a typical configuration, the one or more of the image transfer devices may each comprise a drum-like apparatus, which is rotatable with respect to one or more hydroentangling manifolds.

Subsequent to hydroentanglement, the three-dimensionally imaged fabric may be subjected to one or more variety of post-entanglement treatments. Such treatments may include application of a polymeric binder composition, mechanical compacting, application of surfactant or electrostatic compositions, and like processes.

In accordance with the present invention, a compound three-dimensionally imaged nonwoven fabric comprises the steps of providing a precursor web, which is subjected to a first imparted image, then subsequently, a second imparted image. Each imparted image is imparted by hydroentanglement on a three-dimensional image transfer device. The precursor web is formed into a three-dimensionally imaged nonwoven fabric by hydroentanglement on a three-dimensional image transfer device. The image transfer device defines three-dimensional elements against which the precursor web is forced during hydroentanglement, whereby the fibrous constituents of the web are imaged by movement into regions between the three-dimensional elements and surface asperities of the image transfer device.

Optionally, subsequent to three-dimensional imaging, the compound imaged nonwoven fabric can be treated with a performance or aesthetic modifying composition to further alter the fabric structure or to meet end-use article requirements. A polymeric binder composition can be selected to enhance durability characteristics of the fabric, while maintaining the desired softness and drapeability of the three-dimensionally imaged fabric. A surfactant can be applied so as to impart hydrophilic properties. In addition, electrostatic modifying compound can be used to aid in cleaning or dusting applications. The fabric of the present invention is suitable for home, medical and hygiene applications, wherein such applications include, but are not limited to hard surface wipes, personal care wipes, and antimicrobial wipes.

Other features and advantages of the present invention will become readily apparent from the following detailed description, the accompanying drawings, and the appended claims.

DETAILED DESCRIPTION

Figure 1:
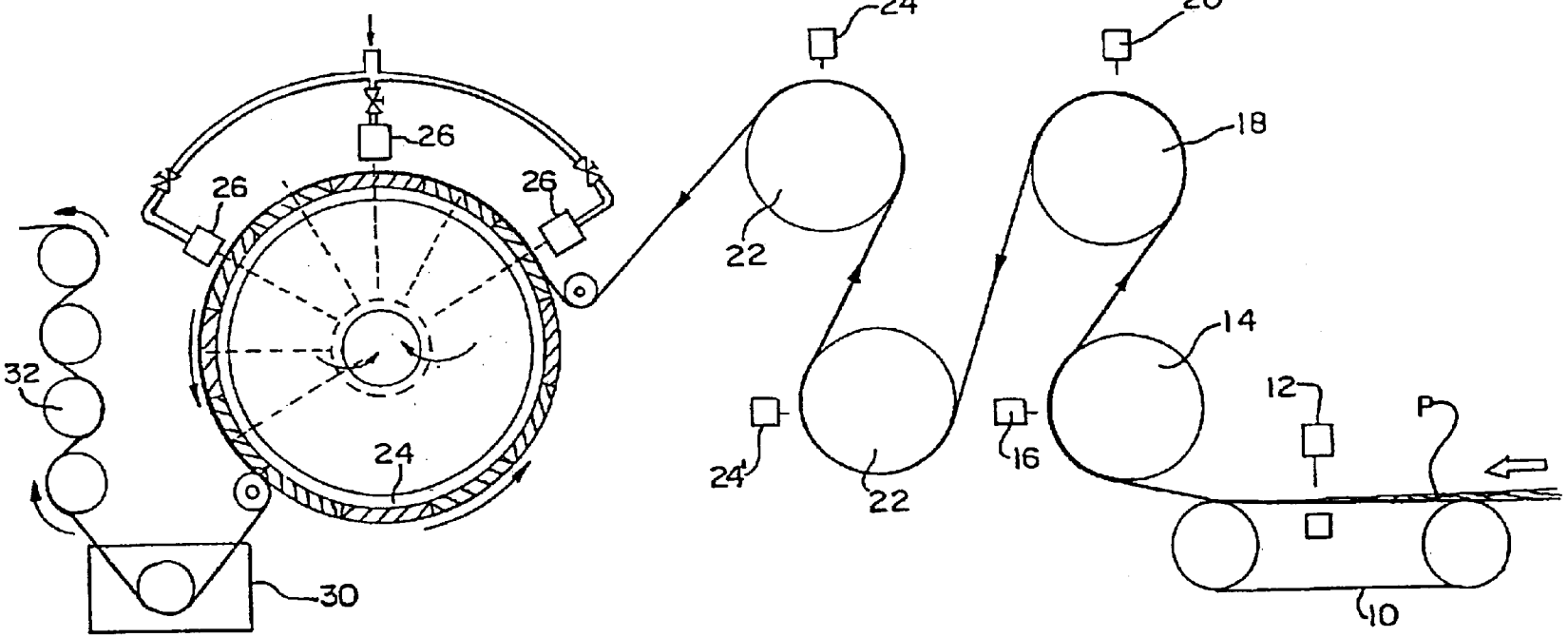
FIG. 1 is a diagrammatic view of an apparatus for manufacturing a durable nonwoven fabric, embodying the principles of the present invention.
Figure 2:
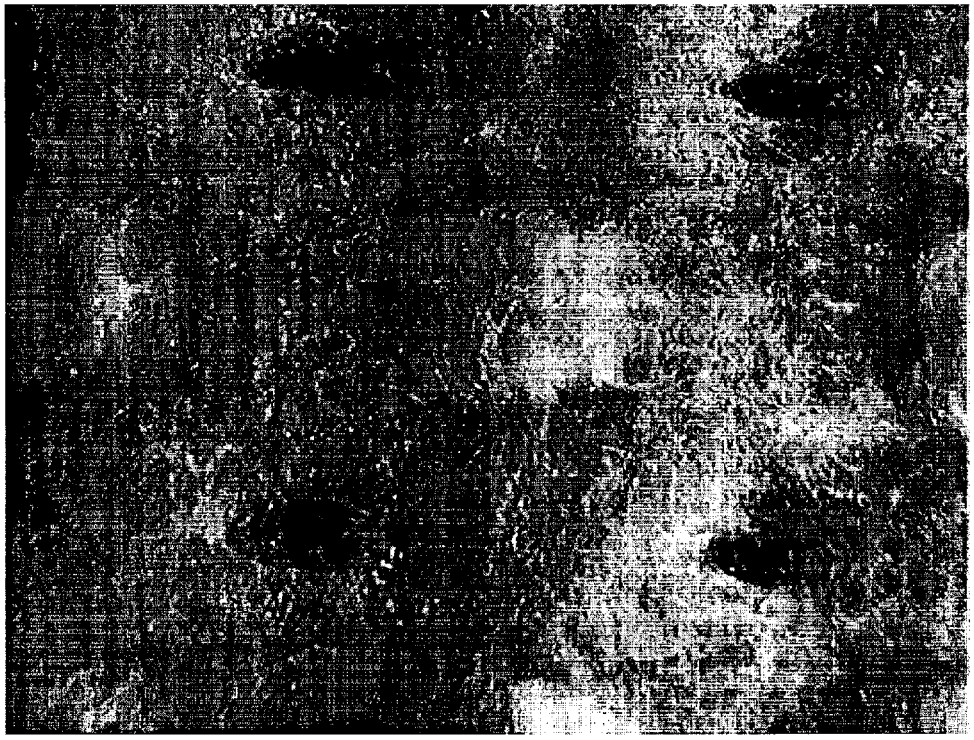
FIG. 2 is a photomicrograph of the fabric herein described in the present invention.
Figure 3:
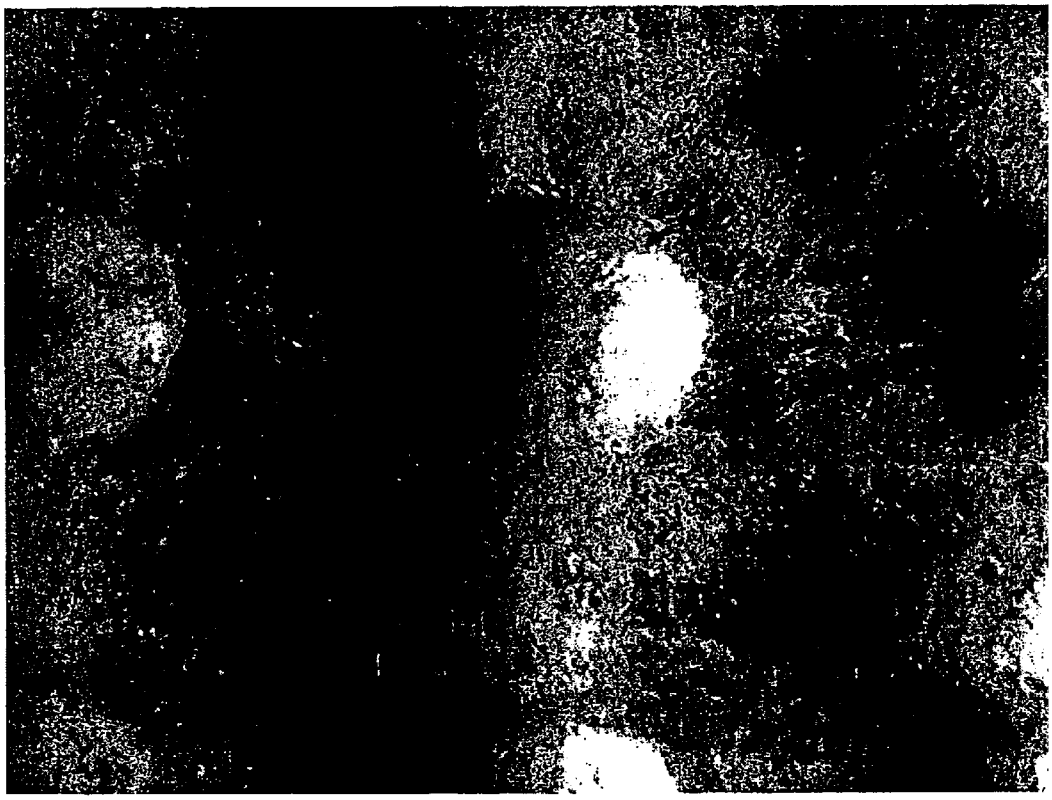
FIG. 3 is a photomicrograph of a comparable fabric without the compound three-dimensional imaging.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

The present invention is directed to a method of forming a nonwoven fabric comprised of sequential three-dimensional images comprising at least a first three-dimensional image and a second three-dimensional image whereby the first and second three-dimensional images are dissimilar.

With reference to FIG. 1, therein is illustrated an apparatus for practicing the present method for forming a nonwoven fabric. The fabric is formed from a fibrous matrix, which typically comprises staple length fibers, but may comprise substantially continuous filaments. The fibrous matrix is preferably carded and cross-lapped to form a fibrous batt, designated F. In a current embodiment, the fibrous batt comprises 100% cross-lap fibers, that is, all of the fibers of the web have been formed by cross-lapping a carded web so that the fibers are oriented at an angle relative to the machine direction of the resultant web. U.S. Pat. No. 5,475,903, hereby incorporated by reference, illustrates a web drafting apparatus.

FIG. 1 illustrates a hydroentangling apparatus for forming the compound imaged nonwoven fabrics in accordance with the present invention. The apparatus includes a first foraminous-forming surface in the form of belt 10 upon which the precursor web P is positioned for pre-entangling by entangling manifold 12. Pre-entangling of the precursor web can be subsequently effected by movement of the web P sequentially over a drum 14 having a foraminous-forming surface, with entangling manifold 16 effecting entanglement. Further entanglement of the web can be effected on the foraminous forming surface of a drum 18 by entanglement manifold 20, with the web subsequently passed over successive foraminous drums 20, for successive entangling treatment by entangling manifolds 24', 24'.

The entangling apparatus of FIG. 1 further includes a three-dimensional imaging drum 24 comprising a three-dimensional image transfer device for effecting imaging of the now-entangled precursor web. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

Optionally, a support layer or scrim may be placed in face to face to face juxtaposition with the fibrous web and hydroentangled on a foraminous surface to form a precursor web P with a first three-dimensional image imparted therein. The fibrous web is hydroentangled on a first foraminous surface to form precursor web P and impart a first three-dimensional image. The present invention contemplates that the optional support layer or scrim be any such suitable material, including, but not limited to, wovens, knits, open mesh scrims, and/or nonwoven fabrics, which exhibit low elongation performance. Two particular nonwoven fabrics of particular benefit are spunbond fabrics, as represented by U.S. Pat. No. 3,338,992, U.S. Pat. No. 3,341,394, U.S. Pat. No. 3,276,944, U.S. Pat. No. 3,502,538, U.S. Pat. No. 3,502,763, U.S. Pat. No. 3,509,009, U.S. Pat. No. 3,542,615, and Canadian Patent No. 803,714, these patents are incorporated by reference, and nanofiber fabrics as represented by U.S. Pat. No. 5,678,379 and U.S. Pat. No. 6,114,017, both incorporated herein by reference.

The present invention contemplates that a nonwoven fabric is formed having compound three-dimensional images by hydroentanglement on a first three-dimensional image transfer device, such as drum 24, to impart a first image to the fabric, followed by hydroentanglement on a second three-dimensional image transfer device, which can again be configured in accordance with the illustrated drum 24, to impart a second, different three-dimensional pattern or image to the fabric. To this end, an additional one of the three-dimensional imaging drums 24 (not show) can be arranged in series with the illustrated drum 24 to thereby successively impart first and second three-dimensional images to the precursor web. The first and second three-dimensional images may be applied to the same surface, or opposite surfaces, of the precursor web. One of the drums 22 positioned upstream of the illustrated drum 24 can be configured as a three-dimensional image transfer device to thereby impart a first image to the precursor web prior to movement of the web (with a first image imparted thereto) onto the illustrated drum 24 for imparting a second three-dimensional image to the web.

After formation of the compound imaged fabric, with first and second three-dimensional images imparted thereto, a performance or aesthetic enhancing composition, such as a binder, can be applied to the compound imaged fabric such as at 30, with the fabric subsequently dried on suitable drying cans 32.

Manufacture of a compound imaged nonwoven fabric embodying the principles of the present invention is initiated by providing the fibrous matrix, which can include the use of staple length fibers, continuous filaments, and the blends of fibers and/or filaments having the same or different composition. Fibers and/or filaments are selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for blending with dispersant thermoplastic resins include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 10 inches, the range of 1 to 3 inches being preferred and the fiber denier selected in the range of 1 to 22, the range of 2.0 to 8 denier being preferred for general applications. The profile of the fiber and/or filament is not a limitation to the applicability of the present invention.

Optionally, subsequent to three-dimensional imaging, the compound imaged nonwoven fabric can be treated with a performance or aesthetic modifying composition to further alter the fabric structure or to meet end-use article requirements, wherein the fabric may be subsequently dried on suitable drying cans 32.

A polymeric binder composition can be selected to enhance durability characteristics of the fabric, while maintaining the desired softness and drapeability of the three-dimensionally imaged fabric. A surfactant can be applied so as to impart hydrophilic properties. In addition, electrostatic modifying compound can be used to aid in cleaning or dusting applications. The fabric of the present invention is suitable for various home, medical and hygiene applications, wherein such applications include, but are not limited to hard surface wipes, personal care wipes, and antimicrobial wipes.

What is claimed is:

1. A method of making a nonwoven fabric comprising at least a first three-dimensional image and a second three-dimensional image wherein said first three-dimensional image differs from said second three-dimensional image, comprising the steps of:

providing a fibrous matrix;

providing a first three-dimensional image transfer device having a movable imaging surface defining a first three-dimensional image;

providing a second three-dimensional image transfer device having a movable imaging surface defining a second three-dimensional image which differs from said first three-dimensional image;

advancing said fibrous matrix onto said first three-dimensional transfer device;

applying hydraulic energy to said fibrous matrix to entangle said fibrous matrix into a precursor web and impart said first three-dimensional image into said precursor web;

advancing said precursor web comprised of said first image onto said second image transfer device so that said web moves with said imaging surface; and hydroentangling said precursor web comprised of said first image on said second image transfer device to impart said second three-dimensional image, which differs from said first three-dimensional image imparted to said fabric, into the resultant nonwoven fabric to impart a compound image presenting aesthetic and tactile qualities representative of both of said imparted images to said fabric.

2. A method of making an imaged nonwoven fabric in accordance with claim 1, wherein said fibrous matrix comprises staple length fibers.

3. A method of making an imaged nonwoven fabric in accordance with claim 1, wherein said fibrous matrix comprises substantially continuous filaments.

4. A method of making an imaged nonwoven fabric in accordance with claim 1, wherein said nonwoven fabric is a hard surface wipe.

5. A method of making an imaged nonwoven fabric in accordance with claim 1, wherein said nonwoven fabric is a personal care wipe.

6. A method of making an imaged nonwoven fabric in accordance with claim 1, wherein said nonwoven fabric is an antimicrobial wipe.

7. A method of making a nonwoven fabric comprising at least a first three-dimensional image and a second three-dimensional image wherein said first three-dimensional image differs from said second three-dimensional image, comprising the steps of:

providing a fibrous matrix;

providing a first three-dimensional image transfer device having a movable imaging surface defining a first three dimensional image;

providing a second three-dimensional image transfer device having a movable imaging surface defining a second three-dimensional image which differs from said first three-dimensional image;

carding said fibrous matrix;

cross-lapping said fibrous matrix to form a precursor web;

advancing said precursor web onto said first three-dimensional transfer device;

applying hydraulic energy to said precursor web to impart said first three-dimensional image into said precursor web;

advancing said precursor web comprised of said first image onto said second image transfer device so that said web moves with said imaging surface; and hydroentangling said precursor web comprised of said first image on said second image transfer device to impart said second three-dimensional image, which differs from said first three-dimensional image imparted to said fabric, into the resultant nonwoven fabric to impart a compound image presenting aesthetic and tactile qualities representative of both of said imparted images to said fabric.

* * * * *